US008245475B1

(12) United States Patent
Thomson et al.

(10) Patent No.: US 8,245,475 B1
(45) Date of Patent: Aug. 21, 2012

(54) ENVIRONMENT FRIENDLY BUILDING SYSTEM UTILIZING RECYCLED/UPCYCLED, COLLAPSED, PREFORMED AND POST CONSUMER PLASTIC MATERIAL

(76) Inventors: Donald W. Thomson, Okotoks (CA); Randell N. Smith, Glenwood Springs, CO (US); Jerald W. Olp, Sr., Glenwood Springs, CO (US)

( * ) Notice: Subject to any disclaimer, the term of this patent is extended or adjusted under 35 U.S.C. 154(b) by 0 days.

(21) Appl. No.: 13/200,544

(22) Filed: Sep. 23, 2011

(51) Int. Cl.
*E04D 1/34* (2006.01)

(52) U.S. Cl. ..... 52/546; 52/518; 52/520; 52/543; 52/478; 52/DIG. 9

(58) Field of Classification Search ..... 52/478, 52/DIG. 9, 520, 522, 536, 543, 544, 546, 52/560
See application file for complete search history.

(56) References Cited

U.S. PATENT DOCUMENTS

| | | | | |
|---|---|---|---|---|
| 822,567 | A | 6/1906 | Williams | |
| 1,339,033 | A | 5/1920 | Martin | |
| 2,434,787 | A | 1/1948 | Budan | |
| 2,565,610 | A * | 8/1951 | Kinghorn | 52/522 |
| 2,766,861 | A * | 10/1956 | Abramson | 52/531 |
| 3,733,309 | A | 5/1973 | Wyeth | |
| 4,057,946 | A * | 11/1977 | Barrett | 52/436 |
| 4,177,906 | A | 12/1979 | Von Hagel | |
| 4,305,516 | A | 12/1981 | Perne et al. | |
| 4,678,617 | A * | 7/1987 | Sykes | 264/458 |
| 5,004,415 | A | 4/1991 | Schulz et al. | |
| 5,282,541 | A | 2/1994 | Chen | |
| 5,301,858 | A | 4/1994 | Hollander | |
| 5,305,900 | A | 4/1994 | Maguire et al. | |
| 5,675,954 | A | 10/1997 | Garcia | |
| 6,120,838 | A | 9/2000 | Zickell | |
| 6,228,503 | B1 | 5/2001 | Zickell | |
| 6,352,235 | B2 | 3/2002 | Cizek | |
| 6,526,718 | B2 * | 3/2003 | Manning et al. | 52/555 |
| 6,706,366 | B2 | 3/2004 | Meyer et al. | |
| 7,062,882 | B2 | 6/2006 | Porat | |
| 7,607,592 | B1 | 10/2009 | Kim | |
| 2001/0022055 | A1 | 9/2001 | Zhang | |
| 2002/0066758 | A1 | 6/2002 | Fadal et al. | |
| 2004/0050815 | A1 | 3/2004 | Blanchester | |
| 2005/0198917 | A1 | 9/2005 | Hokkirigawa et al. | |
| 2006/0266406 | A1 | 11/2006 | Faust et al. | |

* cited by examiner

*Primary Examiner* — Brian Glessner
*Assistant Examiner* — Adam Barlow
(74) *Attorney, Agent, or Firm* — Richard L. Miller

(57) ABSTRACT

An environmentally friendly building system for promoting long term carbon capture and sequestration of roofing and siding by utilizing recycled/upcycled, collapsed, preformed, and post consumer plastic material. The system includes a plurality of tiles. The plurality of tiles interlock with each other to form overlapping courses of laterally staggered roofing or siding. Each tile includes a bottle and a cap connector. The cap connector of each tile caps off the bottle of an associated tile, and hooks into the bottle laying on top thereof so as to hold the overlapping courses of the laterally staggered roofing or siding in place. The bottle of each tile is made from recycled/upcycled, collapsed, preformed, and post consumer plastic material for promoting the long term carbon capture and sequestration of the laterally staggered roofing or siding so as to be environmentally friendly.

55 Claims, 7 Drawing Sheets

ENVIRONMENT FRIENDLY BUILDING SYSTEM UTILIZING RECYCLED/UPCYCLED, COLLAPSED, PREFORMED AND POST CONSUMER PLASTIC MATERIAL

1. BACKGROUND OF THE INVENTION

A. Field of the Invention

The embodiments of the present invention relate to a roofing and siding system, and more particularly, the embodiments of the present invention relate to an environmentally friendly building system for promoting long term carbon capture and sequestration of roofing and siding by utilizing recycled/upcycled, collapsed, preformed, and post consumer plastic material.

B. Description of the Prior Art

[1]The greatest enemy of roofs and walls is water. It has its merits in brooks, bathtubs, and drinking glasses, but in the form of rain and snow and ice it can be demoniacal. Pelting water penetrates and infiltrates. Water driven by wind, icing, or capillary action defies gravity and flows upward, doing damage in hidden places.

[1]Roofs and Siding, William Frankel, Library of Congress catalogue card number 77-090094, Time-Life Books Inc., Chicago, Ill., 1979, Second Printing, Page 7.

Through the ages, ways to build waterproof walls and roofs have been searched. The ideal surfacing material would be as seamless as glass, but only mason—brick, stone or stucco—has ever approached this ideal, and then only for siding. In applying every other material, the admirable pattern of the husk of an ear of corn has been followed, which protects the kernels from rain and sun with overlapping layers of leaves.

An ordinary shingle—whether on a roof or a wall, whether of asbestos, asphalt, wood, slate, or tile—illustrates the principle of the husk on the surface of a house. Water cannot flow up the back of a shingle that overlaps the one beneath it. Lateral overlap, in staggered joints between shingles, prevents leakage from sideways flow. A soundly shingled surface tames water, causing it to meander in rivulets down the overlap of one shingle, dropping to the overlap of the next, until it reaches the bottom course and falls to the ground. The principle of overlap explains why siding and roofing is applied from bottom to top, and not the other way around.

Overlapping is also key to roll roofing, and to clapboard, and aluminum and vinyl siding. The materials are laid on in long and overlapped horizontal strips, and need only a few vertical joints that can be staggered. In aluminum and vinyl siding and in roll roofing, these vertical joints are also overlapped. At the ridge of a roof, there is a double overlap, in which pieces of material that overlap each other are also laid to overlap the top course on both sides of the roof. The principle of overlap is all-important in the installation of flashing—the metal strips that waterproof the joints of a roof. Where a roof meets a vertical surface, such as a dormer or a chimney, the flashing actually overlaps itself as well as the roof. Counterflashing, fastened to the vertical surface, overlaps a channel-like base flashing, fastened to the roof. Working together, the two layers of flashing direct the water safely down toward the eave.

Overlapped flashing, roofing, and siding make up the surface of a house's husk. For some jobs, deeper layers that lie below the surface have to be worked with. Shingles and clapboard are supported from below by fiber or plywood sheathing that in turn is nailed to studs or rafters. In addition, many walls and roofs have a special barrier to dampness, such as asphalted building paper, nailed to the sheathing and overlapped.

Carbon capture and sequestration is based on capturing carbon dioxide ($CO_2$) from large point sources, such as fossil fuel power plants, and storing it in such a way that it does not enter the atmosphere. It can also be used to describe the scrubbing of $CO_2$ from ambient air as a geoengineering technique. Although $CO_2$ has been injected into geological formations for various purposes, the long term storage of $CO_2$ is a relatively new concept.[2]

[2]Please see footnote 1.

Numerous innovations for bottle cap/bottle/cap accessories, and roof tiles and asphalt have been provided in the prior art, which will be described below in chronological order to show advancement in the art, and which are incorporated herein by reference thereto. Even though these innovations may be suitable for the specific individual purposes to which they address, nevertheless, they differ from the embodiments of the present invention in that they do not teach an environmentally friendly building system for promoting long term carbon capture and sequestration of roofing and siding by utilizing recycled/upcycled, collapsed, preformed, and post consumer plastic material.

(1) U.S. Pat. No. 822,567 to Williams

U.S. Pat. No. 822,567 issued to Williams on Jun. 5, 1906 teaches a bottle or jar closure including a cap having yielding sides, a split ring encircling the sides, and a lever having a cylindrical head to which the ends of the ring are connected.

(2) U.S. Pat. No. 1,339,033 to Martin

U.S. Pat. No. 1,339,033 issued to Martin on May 4, 1920 teaches a roofing structure including a plurality of tiles arranged in courses. Each tile is provided near one edge thereof with a groove that increases in width downwardly, and at its opposite edges thereof, with an upwardly bulging flange projecting laterally beyond the same. The flange has a depending rib spaced from the edges thereof. The rib increases in width downwardly. The rib of one tile is adapted for insertion within the groove of an adjacent tile. Plastic material within the groove anchors the rib therein. Each tile is provided at is upper end with a transverse recess having its top open. The top is covered by the lower end of the adjacent tile in the upper course. Plastic material within the transverse recess binds the tiles together. Each tile is further provided centrally thereof upon its lower surface with a groove to receive the flange whereby the tiles in the different courses are arranged to break joint.

(3) U.S. Pat. No. 2,434,787 to Budan

U.S. Pat. No. 2,434,787 issued to Budan on Jan. 20, 1948 in U.S. class 215 and subclass 38 teaches a cap including a central area surrounded by a circular seat portion, a circular flange extending downwardly from the outer edge of the seat portion, and two diametrically opposite spring ears. Each spring ear has side edges. The ears extend downwardly from the flange. At least of the ears has in one of its sides edges an arcuate recess that produces a hook with a point suited to hooking onto the finger-hold flap of a conventional milk bottle cap. The point is directed toward the aforesaid circular flange. The ear has also a central downwardly directed point portion to indent or puncture a conventional milk bottle cap. The latter portion affords an anchored fulcrum point for use in prying off the conventional cap when the aforesaid hook is applied under the finger-hold flap thereof. The ear which carries the downwardly directed point portion is widened superjacent to the downwardly directed point portion thus affording stop shoulders that prevent more than a slight penetration of the cap by the latter point portion when used as a fulcrum as aforesaid.

(4) U.S. Pat. No. 3,733,309 to Wyeth

U.S. Pat. No. 3,733,309 issued to Wyeth on May 15, 1973 in U.S. class 260 and subclass 75T teaches a hollow, biaxially oriented, thermoplastic article, particularly a bottle, prepared from polyethylene terephthlate. The article has an inherent viscosity of at least 0.55, a density of about 1.331 to 1.402, and a ratio of article weight in grams to volume cubic centimeters of about 0.2 to 0.005:1 so as to have excellent strength properties, are impact resistant, and are capable of holding liquids under pressure as high as about 100 psi. at a temperature of about 50° C. without significant deformation making the articles useful in bottling liquids under pressure, such as beer, carbonated beverages, or aerosols.

(5) U.S. Pat. No. 4,177,906 to Von Hagel

U.S. Pat. No. 4,177,906 issued to Von Hagel on Dec. 11, 1979 in U.S. class 215 and subclass 252 teaches a milk bottle having an antitamper cap having a plug adapted to fit into the mouth of the bottle. The neck of the bottle is tapered toward the mouth and the cap has apparatus for restraining the top of the neck to keep the mouth in good sealing contact with the plug when the cap is screwed on.

(6) U.S. Pat. No. 4,305,516 to Perne et al

U.S. Pat. No. 4,305,516 issued to Perne et al. on Dec. 15, 1981 in U.S. class 215 and subclass 252 teaches a cap provided with a guarantee strip for stoppering receptacles with a threaded neck. The guarantee strip is formed by at least two separate elements connected to the base of the skirt of the cap by two bosses, of which one, is located ahead of the other as the cap is screwed on and is more resistant than the other. The one boss is severed when the cap is unscrewed.

(7) U.S. Pat. No. 5,004,415 to Schulz et al

U.S. Pat. No. 5,004,415 issued to Schulz et al. on Apr. 2, 1991 in U.S. class 425 and subclass 297 teaches production of concrete roof tiles in an extrusion process, in which a continuous layer of fresh concrete is deposited on pallets supplied in a continuous row to a depositing apparatus and is subsequently compacted by way of a shaping roller and slipper and, if appropriate, profiled, and then the compacted layer of fresh concrete is cut at a cutting station into roof-tile moldings of equal length with a rear edge and a front edge, and the front edge is trimmed. To increase the weathering resistance and the strength of the front edge of the concrete roof tiles produced in this way, and to reduce the efflorescence that occurs in this region, a rounding or bevel starting from the lower cut edge adjacent to the pallet and extending up to the top side of the roof-tile moldings is produced, preferably in steps, on the front edge as a result of a compacting of material. The apparatus provided for this purpose has, as a trimming tool, an indentation tool that matches the profile of the layer of fresh concrete and which, during its movement penetrating into the layer of fresh concrete, compacts the front edge portion produced in the preceding work cycle over the entire cross-section of the latter.

(8) U.S. Pat. No. 5,282,541 to Chen

U.S. Pat. No. 5,282,541 issued to Chen on Feb. 1, 1994 in U.S. class 215 and subclass 229 teaches a cap locking device for a water bottle, which includes a bottle cap threadably closing an inner bottle, and a push button and a nipple pusher. The bottle cap is shaped like a shell head having a diametric opening. A tubular post in the opening for a nipple fixed on top of a drinking tube extends vertically in the inner bottle to fit therein, and a push button is pivotally fitted in one side portion of the opening and the liftable nipple pusher is pivotally fitted in another side portion of the opening. The liftable nipple pusher is pushed down to close the opening or raised up to open the opening by pushing the push button for the nipple exposed for sucking the content of the inner bottle contained in an outer bottle.

(9) U.S. Pat. No. 5,301,858 to Hollander

U.S. Pat. No. 5,301,858 issued to Hollander on Apr. 12, 1994 in U.S. class 224 and subclass 148.2 teaches a recreational water bottle system including a primary vessel for holding liquids, a watertight cap having a bottle tube extending therethrough into the primary vessel, a drinking tube for delivering liquids to a user, and an oversleeve adapter disposed between the bottle tube and the drinking tube for passing liquids and for selectively holding the bottle tube and the drinking tube in structural alignment. The system is adapted to be selectively mounted onto the frame of a bicycle or onto the body of an athlete, or used as a hand held sport bottle.

(10) U.S. Pat. No. 5,305,900 to Maguire et al

U.S. Pat. No. 5,305,900 issued to Maguire et al. on Apr. 26, 1994 in U.S. class 215 and subclass 245 teaches a bottle cap device formed so as to have a positive sealing arrangement for use with bottles that store gaseous fluid, such as soda water and like beverages. The bottle cap device includes a threaded cap body and a hinged cover or lid that is formed having a sealing annular structure that compresses an annular gasket against the mouth of the bottle by a depending convex wall that engages a gasket mounted when the cover is locked in a close sealed position and a pressure release latch for limiting the movement of the hinged cover after it is unlocked from the cap body to relieve pressure within the bottle.

(11) U.S. Pat. No. 5,675,954 to Garcia

U.S. Pat. No. 5,675,954 issued to Garcia on Oct. 14, 1997 in U.S. class 52 and subclass 518 teaches a tile obtained from recycling worn rubber tires of automobiles. The tire is chopped into lengths of about 10" to 16" and then about 4" is lopped off the two side rim parts. The outer surface of the remaining central rolling tread part is run down to make it smooth and even, and the tile is heated to between 210° and 300° F. for about one-half hour to straighten the longitudinal curvature. The cross curvature is maintained for a colonial type tile aspect.

(12) U.S. Pat. No. 6,120,838 to Zickell

U.S. Pat. No. 6,120,838 issued to Zickell on Sep. 19, 2000 in U.S. class 427 and subclass 186 teaches a recycled asphalt roofing material for use on sloped roofs, which provides the required elevated melt point without using methods of oxidizing the asphalt prior to incorporation into the roofing material. The recycled asphalt roofing material is made up of approximately 30% flux asphalt and approximately 70% reclaimed asphalt roofing material. The fibrous backing in the reclaimed material modifies the asphalt in such a way as to provide the required elevated melt point. The manufacturing process for recycled fiberglass mat-based roll and shingle roofing, in its preferred embodiment, consists of impregnating a roofing material backbone, such as a fiberglass or polyester mat, with recycled asphalt material to form inner and outer layers of recycled material, and then applying optional second inner and outer layers of standard asphalt coating to the inner and outer layers of the recycled material. The second coating encapsulates and seals the recycled material.

(13) U.S. Pat. No. 6,228,503 to Zickell

U.S. Pat. No. 6,228,503 issued to Zickell on May 8, 2001 in U.S. class 428 and subclass 489 teaches a recycled asphalt roofing material for use on sloped roofs, which provides the required elevated melt point without using methods of oxidizing the asphalt prior to incorporation into the roofing material. The recycled asphalt roofing material is made up of approximately 30% flux asphalt and approximately 70% reclaimed asphalt roofing material. The fibrous backing in the reclaimed material modifies the asphalt in such a way as to provide the required elevated melt point. The manufacturing process for recycled fiberglass mat-based roll and shingle roofing, in its preferred embodiment, consists of impregnating a roofing material backbone, such as a fiberglass or polyester mat, with recycled asphalt material to form inner and outer layers of recycled material, and then applying optional second inner and outer layers of standard asphalt coating to the inner and outer layers of the recycled material. The second coating encapsulates and seals the recycled material.

(14) United States Patent Application Publication Number 2001/0022055 to Zhang

United States Patent Application Publication Number 2001/0022055 published to Zhang on Sep. 20, 2001 in U.S. class 52 and subclass 309.1 teaches a shaped plastic roof tile, preferably, one shaped like a slate tile. The tile is constructed of the combination of a thermoplastic, preferably, one or more polyolefin polymers, and a chlorine-containing polymer in an amount to provide a final chlorine content to the tile of between 1% and 65% by weight. The polyolefin polymer is, preferably, a combination of polyethylene and polypropylene derived from recycled material. The chlorine-containing polymer is one or more polymers selected from the group consisting of polyvinyl chloride (PVC), chlorinated polyvinyl chloride (CPVC), polyvinylidene dichloride (PVDC), chlorinated polyolefin, acrylate modified PVC, neoprene rubber, copolymers of vinyl chloride with ethylene, propylene, vinyl acetate, vinyl dichloride, and butadiene, copolymers of vinylidene chloride with butyl acrylate and nitrile, and polymer blends of PVC with acrylonitrile-butadiene-styrene (ABS), acrylic-styrene-acrylonitrile (ASA), nitrile rubber, and polyvinyl acetate (EVA). Preferably, the chlorine-containing polymer is recycled neoprene rubber.

(15) U.S. Pat. No. 6,352,235 to Cizek

U.S. Pat. No. 6,352,235 issued to Cizek on Mar. 5, 2002 in U.S. class 248 and subclass 692 teaches a combination bottle hook and bottle cap wrench device for suspending a plastic beverage bottle from a nearby structure and for providing a wrench mechanism for aiding the user to loosen the bottle cap of the beverage bottle. The device includes an L-shaped piece of plastic material having first and second legs extending at substantially right angles relative to one another. One leg has an open-ended C-shaped head portion for clamping around the neck of the beverage bottle. The other leg forms a retaining member for placement behind a portion of the structure on which it is desired to hook the beverage bottle. The inner surface of the C-shaped head portion is serrated or notched for purposes of gripping the bottle cap when it is desired to loosen the bottle cap.

(16) United States Patent Application Publication Number 2002/0066758 to Fadal et al United States Patent Application Publication Number 2002/0066758 published to Fadal et al. on Jun. 6, 2002 in U.S. class 224 and subclass 148.7 teaches a cap or closure including an integrated clip in the cap. The cap is designed to fit on standard bottle constructions. The clip may be either an integrated feature of a reconfigured cap or may be an add-on adapted to be secured to an existing cap. Alternatively, the integrated clip is part of the cap mold or an add-on clip is frictionally mounted, sonic-welded, or otherwise glued or secured to an existing cap design. The bottle container is not altered and may be manufactured, filled, labeled, and process using existing equipment. The cap is then secured to the bottle with the integral clip, or the clip can be added as a downstream step after the bottle is closed and sealed.

(17) U.S. Pat. No. 6,706,366 to Meyer et al

U.S. Pat. No. 6,706,366 issued to Meyer et al. on Mar. 16, 2004 in U.S. class 428 and subclass 156 teaches a curved roofing tile that is formed of strong materials so that it may be fabricated in an extra-width configuration. Strengthening ridges and connector ridges are compression molded so the roofing tile forms a one-piece unit. To help the ecology, recycled materials, such as rubbers and plastics, are combined.

(18) United States Patent Application Publication Number 2004/0050815 to Blanchester United States Patent Application Publication Number 2004/0050815 published to Blanchester on Mar. 18, 2004 in U.S. class 215 and subclass 399 teaches a carrying device for attaching to a bottle, around a bottle neck. The carrying device has a ring segment that is received by the neck below the bottle cap and a hook segment attached to the ring segment. The ring segment is shaped as a substantially thin planar disc, and the hook segment is planar and thin. The hook segment and the ring segment extend in a common plane and are foldable along an axis line between the hook segment and the ring segment. The axis line is perpendicularly to a connection line between centers of the openings of the hook segment and the ring segment. The planar ring segment and hook segment can be folded toward each other and be secured around bottle neck by a cap. In use, the carrying device is unfolded and has the hook segment available for attachment.

(19) United States Patent Application Publication Number 2005/0198917 to Hokkirigawa et al United States Patent Application Publication Number 2005/0198917 published to Hokkirigawa et al. on Sep. 15, 2005 in U.S. class 52 and subclass 173.1 teaches a tile made of a fire-resistant ceramic, which is obtained by mixing and kneading defatted bran obtained from rice bran and a thermosetting resin, primarily baking the resulting mixture in an inert gas at 700° C. to 1000° C., crushing the resulting product into carbonized powder, mixing and kneading the carbonized powder with a ceramic powder, a solvent and, optionally, a binder to provide a plasticized mixture (ceramic-solvent mixture), pressure-forming the mixture at a compression pressure of 10 MPa to 100 MPa, and heat-treating the resulting compact again in an atmosphere of an inert gas at 500 to 1400° C.

(20) U.S. Pat. No. 7,062,882 to Porat

U.S. Pat. No. 7,062,882 issued to Porat on Jun. 20, 2006 in U.S. class 52 and subclass 12 teaches a roofing tile configured to allow liquid, such as rain, to flow through the roofing tile. The roofing tile allows the design of a roof with hidden gutters.

(21) United States Patent Application Publication Number 2006/0266406 to Faust et al United States Patent Application Publication Number 2006/0266406 published to Faust et al. on Nov. 30, 2006 in U.S. class 136 and subclass 244 teaches an integrated solar-voltaic roof tile that is durable, consistent in color with common roofing materials, and allows for installation of a roof system that produces cost-effective electricity from solar power. The design includes an elastomeric or polymeric substrate roof tile material, an integrated solar-voltaic cell that is molded into the roof tile and appears as an integral part of the roof tile material, a protective covering material composed of coated glass or a clear polymeric material, and electrical leads and plates built into the substrate material that connect to the solar-voltaic cell, and when roof tiles are installed in a traditional fashion, the current from each solar voltaic cell flows through the roof system to a common electricity collector point from which it is flows to a induction system that coverts direct current into alternating current and from which the current flows to the house electrical system or the public electricity grid.

(22) U.S. Pat. No. 7,607,592 to Kim

U.S. Pat. No. 7,607,592 issued to Kim on Oct. 27, 2009 in U.S. class 239 and subclass 377 teaches an apparatus for accessorizing water and beverage bottles, which includes a water mister, a portable humidifier, a vitamin or nutritional supplement dispenser, and other useful accessories.

It is apparent that numerous innovations for bottle cap/bottle/cap accessories, and roof tiles and asphalt have been provided in the prior art, which are adapted to be used. Furthermore, even though these innovations may be suitable for the specific individual purposes to which they address, nevertheless, they would not be suitable for the purposes of the embodiments of the present invention as heretofore described, namely, an environmentally friendly building system for promoting long term carbon capture and sequestration of roofing and siding by utilizing recycled/upcycled, collapsed, preformed, and post consumer plastic material.

2. SUMMARY OF THE INVENTION

Thus, an object of the embodiments of the present invention is to provide an environmentally friendly building system for promoting long term carbon capture and sequestration of roofing and siding by utilizing recycled/upcycled, collapsed, preformed, and post consumer plastic material, which avoids the disadvantages of the prior art.

Briefly stated, another object of the embodiments of the present invention is to provide an environmentally friendly building system for promoting long term carbon capture and sequestration of roofing and siding by utilizing recycled/upcycled, collapsed, preformed, and post consumer plastic material. The system includes a plurality of tiles. The plurality of tiles interlock with each other to form overlapping courses of laterally staggered roofing or siding. Each tile includes a bottle and a cap connector. The cap connector of each tile caps off the bottle of an associated tile and hooks into the bottle laying on top thereof so as to hold the overlapping courses of the laterally staggered roofing or siding in place. The bottle of each tile is made from recycled/upcycled, collapsed, preformed, and post consumer plastic material for promoting the long term carbon capture and sequestration of the laterally staggered roofing or siding so as to be environmentally friendly.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying figures of the drawing.

3. BRIEF DESCRIPTION OF THE FIGURES OF THE DRAWING

The figures of the drawing are briefly described as follows.

4. LIST OF REFERENCE NUMERALS UTILIZED IN THE FIGURES OF THE DRAWING

Figure 1:
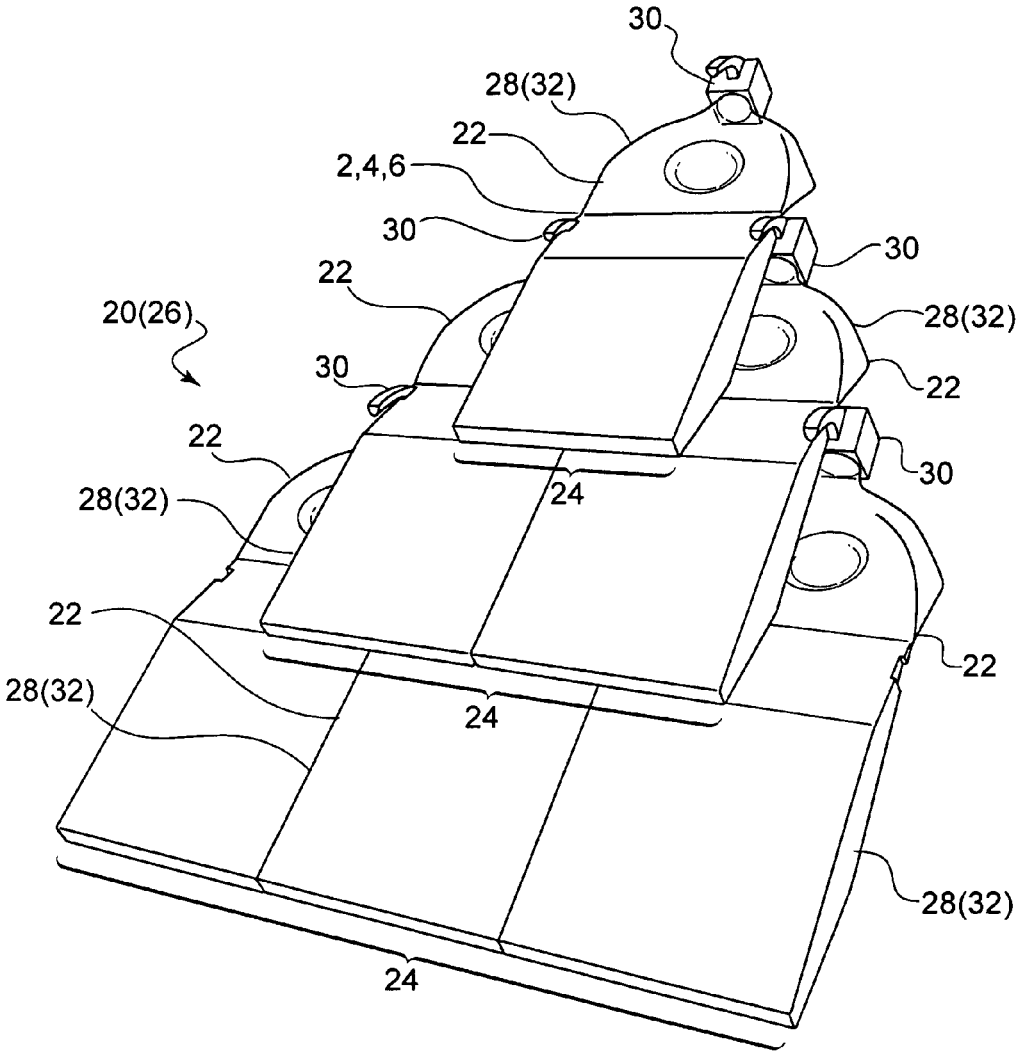
FIG. 1 is a diagrammatic perspective view of the environmentally friendly building system of the embodiments of the present invention promoting long term carbon capture and sequestration of roofing and siding by utilizing recycled/upcycled, collapsed, preformed, and post consumer plastic material.

A. General.

20 environmentally friendly building system of embodiments of present invention for promoting long term carbon capture and sequestration of roofing and siding by utilizing recycled/upcycled, collapsed, preformed, and post consumer plastic material B. Overall Configuration of Environmentally Friendly System 20.

22 plurality of tiles

24 overlapping courses of laterally staggered roofing or siding 26

26 laterally staggered roofing or siding

28 bottle of each tile of plurality of tiles 22

30 cap connector of each tile of plurality of tiles 22

32 recycled/upcycled, collapsed, preformed, and post consumer plastic material of bottle 28 of each tile of plurality of tiles 22 for promoting long term carbon capture and sequestration of laterally staggered roofing or siding 26 so as to be environmentally friendly C. Specific Configuration of First Embodiment of Bottle 128.

128 bottle

134 upper wall of bottle 128

136 lower wall of bottle 128.

138 intermediate line of upper wall 134 of bottle 128

140 intermediate line of lower wall 136 of bottle 128

142 pinched line of bottle 128

144 upper portion of bottle 128

146 lower portion of the bottle 128

148 dimple of upper portion 144 of bottle 128 for providing initial receptacle for water flowing down between adjacent tiles 22 thereabove

150 neck of bottle 128

152 blind slot of lower portion 146 of bottle 128

154 arm of connector cap 30 of tile 22

D. Specific Configuration of Second Embodiment of Bottle 228.

228 bottle

248 crushed-in dimple 148 of upper wall 260 of crushed-flat two-liter bottle 258 of two-liter bottle 256 of bottle 228 for providing initial receptacle for water flowing down between adjacent tiles 22 thereabove

254 arm of connector cap 30 of tile 22

256 preexisting two-liter bottle of bottle 228

258 crushed-flat two-liter bottle of preexisting two-liter bottle 256 of bottle 228

260 upper wall of crushed-flat two-liter bottle 258 of preexisting two-liter bottle 256 of bottle 228

262 lower wall of crushed-flat two-liter bottle 258 of preexisting two-liter bottle 256 of bottle 228

264 crushed-flat closed bottom of crushed-flat two-liter bottle 258 of preexisting two-liter bottle 256 of bottle 228

265 neck of crushed-flat two-liter bottle 258 of preexisting two-liter bottle 256 of bottle 228

266 blind slot of crushed-flat two-liter bottle 258 of preexisting two-liter bottle 256 of bottle 228

268 material in part of crushed-flat two-liter bottle 258 of preexisting two-liter bottle 256 of bottle 228

270 air, a cellular air entrained concrete, or a closed-cell polyurethane foam of material 268 in part of crushed-flat two-liter bottle 258 of preexisting two-liter bottle 256 of bottle 228

E. Specific Configuration of Third Embodiment of Bottle 328.

328 bottle

334 upper wall of bottle 328

336 lower wall of bottle 328

338 intermediate line of upper wall 334 of bottle 328

340 intermediate line of lower wall 336 of bottle 328

342 pinched line of bottle 328

344 upper portion of bottle 328

346 lower portion of bottle 328

348 dimple of upper portion 344 of bottle 328 for providing initial receptacle for water flowing down between adjacent tiles 22 thereabove

350 neck of bottle 328

352 blind slot of lower portion 346 of bottle 328

354 arm of connector cap 30 of tile 22

356 pair of side edges of upper portion 344 of bottle 328

358 pair of notches of pair of side edges 354 of upper portion 344 of bottle 328, respectively F. Specific Configuration of First Embodiment of Cap Connector 500.

500 cap connector

530 body of cap connector 500

532 arm of cap connector 500

536 blind bore in body 530 of cap connector 500 for engaging cap of bottle 128, 328

538 terminal end of arm 532 of cap connector 500

540 longitudinal axis of lateral symmetry of arm 532 of cap connector 500

542 pair of through bores in body 530 of cap connector 500 for receiving pair of screws for attaching tile 22 of laterally staggered roofing or siding 26

549 sides of body 530 of cap connector 500

550 rounded edges of body 530 of cap connector 500 for protecting hand of user

552 protruding ribs of body 530 of cap connector 500 for assisting in fastening and preventing twisting of cap connector 500 once installed G. Specific Configuration of Second Embodiment of Cap Connector 600.

600 cap connector

630 body of cap connector 600

632 arm of cap connector 600

634 fingers of cap connector 600 for engaging bottle 228 in such manner so as to avoid puncturing bottle 228

636 through bore in body 630 of cap connector 600

638 terminal end of arm 632 of cap connector 600

640 longitudinal axis of lateral symmetry of arm 632 of cap connector 600

642 pair of through bores in body 630 of cap connector 600

648 vertically-oriented serrations of peripheral wall 650 defining through bore 636 in body 630 of cap connector 600 for frictionally engaging vertical serrations 652 on cap 656 of bottle 228 for more better gripping cap 656 of bottle 228.

650 peripheral wall defining through bore 636 in body 630 of cap connector 600

652 vertical serrations on cap 656 of bottle 228

654 pair of arcuate wings of fingers 634 of cap connector 600 for avoiding puncturing bottle 228

656 cap of bottle 228

658 pair of screws for attaching tile 22 of laterally staggered roofing or siding 26

5. DETAILED DESCRIPTION OF THE PREFERRED EMBODIMENTS

A. General.

Referring now to the figures, in which like numerals indicate like parts, and particularly to FIG. 1, which is a diagrammatic perspective view of the environmentally friendly building system of the embodiments of the present invention promoting long term carbon capture and sequestration of roofing and siding by utilizing recycled/upcycled, collapsed, preformed, and post consumer plastic material, the environmentally friendly building system of the embodiments of the present invention is shown generally at 20 for promoting long term carbon capture and sequestration of roofing and siding by utilizing recycled/upcycled, collapsed, preformed, and post consumer plastic material.

B. Overall Configuration of the Environmentally Friendly Building System 20.

The environmentally friendly building system 20 comprises a plurality of tiles 22. The plurality of tiles 22 interlock with each other to form overlapping courses 24 of laterally staggered roofing or siding 26.

Each tile 22 comprises a bottle 28 and a cap connector 30. The cap connector 30 of each tile 22 caps off the bottle 28 of an associated tile 22 and hooks into the bottle 28 laying on top thereof so as to hold the overlapping courses 24 of the laterally staggered roofing or siding 26 in place. The bottle 28 of each tile 22 is made from recycled/upcycled, collapsed, preformed, and post consumer plastic material 32.for promoting long term carbon capture and sequestration of the laterally staggered roofing or siding 26 so as to be environmentally friendly.

C. Specific Configuration of a First Embodiment of the Bottle 128.

The specific configuration of the bottle 128 can best be seen in FIGS. 2 and 3, which are, respectively, a diagrammatic perspective view of a first embodiment of an interlocking tile of the environmentally friendly building system of the present invention identified by ARROW 2 in FIG. 1, and a diagrammatic perspective view taken generally in the direction of ARROW 3 in FIG. 2, and as such, will be discussed with reference thereto.

The bottle 128 has an upper wall 134 and a lower wall 136.

The upper wall 134 of the bottle 128 has an intermediate line 138. The lower wall 136 of the bottle 128 has an intermediate line 140.

The intermediate line 138 of the upper wall 134 of the bottle 128 and the intermediate line 140 of the lower wall 136 of the bottle 128 contact each other so as to allow the bottle 128 to have a pinched line 142 thereat.

The upper wall 134 of the bottle 128 and the lower wall 136 of the bottle 128 are relatively close to each other, and in combination with the pinched line 142 of the bottle 128, give an appearance that the bottle 128 is crushed.

The pinched line 142 of the bottle 128 divides the bottle 128 into an upper portion 144 and a lower portion 146. The upper portion 144 of the bottle 128 and the lower portion 146 of the bottle 128 taper towards the pinched line 142 of the bottle 128.

The upper portion 144 of the bottle 128 has a dimple 148. The dimple 148 of the upper portion 144 of the bottle 128 is in the upper wall 134 of the bottle 128, and is for providing an initial receptacle for water flowing down between adjacent tiles 22 thereabove.

The bottle 128 further has a neck 150. The neck 150 of the bottle 128 extends from the upper portion 144 of the bottle 128 to be received by the cap connector 30.

The lower portion 146 of the bottle 128 has a blind slot 152. The blind slot 152 of the lower portion 146 of the bottle 128 extends laterally in the lower wall 136 of the bottle 128, and receives an arm 154 of the connector cap 30 of the tile 22 therebelow.

D. Specific Configuration of a Second Embodiment of the Bottle 228.

The specific configuration of the bottle 228 can best be seen in FIGS. 4 and 5, which are, respectively, a partial cutaway diagrammatic perspective view of a second embodiment of an interlocking tile of the environmentally friendly building system of the present invention identified by ARROW 4 in FIG. 1, and a diagrammatic side elevational view taken generally in the direction of ARROW 5 in FIG. 4, and as such, will be discussed with reference thereto.

The bottle 228 is a preexisting two-liter bottle 256 that is a common container for soft drinks. The preexisting two-liter bottle 256 of the bottle 228 is made from polyethylene terephthlate, also known as PET plastic, using the blow molding process.[3]

[3]Please see http://en.wikipedia.org/wiki/Two-liter_bottle.

A typical preexisting two-liter bottle 256 is taught by U.S. Pat. No. 3,733,309 issued to Wyeth on May 15, 1973 in U.S. class 260 and subclass 75T incorporated herein by reference thereto, and discussed under sub¶ 4 of the Description of the prior art section above.

The preexisting two-liter bottle 256 of the bottle 228 is a crushed-flat two-liter bottle 258. The crushed-flat two-liter bottle 258 of the preexisting two-liter bottle 256 of the bottle 228 has an upper wall 260, a lower wall 262, a crushed-flat closed bottom 264, and a neck 265.

The upper wall 260 of the crushed-flat two-liter bottle 258 of the preexisting two-liter bottle 256 of the bottle 228 and the lower wall 262 of the crushed-flat two-liter bottle 258 of the preexisting two-liter bottle 256 of the bottle 228 are in intimate generally flat relationship to each other, with the crushed-flat closed bottom 264 of the crushed-flat two-liter bottle 258 of the preexisting two-liter bottle 256 of the bottle 228 bent onto the lower wall 262 of the crushed-flat two-liter bottle 258 of the preexisting two-liter bottle 256 of the bottle 228 so as to form a blind slot 266 therebetween.

The blind slot 266 of the crushed-flat two-liter bottle 258 of the preexisting two-liter bottle 256 of the bottle 228 extends laterally thereacross, and receives the arm 254 of the connector cap 30 of the tile 22 therebelow.

The upper wall 260 of the crushed-flat two-liter bottle 258 of the preexisting two-liter bottle 256 of the bottle 228 has a crushed-in dimple 248. The crushed-in dimple 248 of the upper wall 260 of the crushed-flat two-liter bottle 258 of the preexisting two-liter bottle 256 of the bottle 228 is just below the neck 265 of the crushed-flat two-liter bottle 258 of the preexisting two-liter bottle 256 of the bottle 228, and is for providing an initial receptacle for water flowing down between adjacent tiles 22 thereabove.

The crushed-flat two-liter bottle 258 of the preexisting two-liter bottle 256 of the bottle 228 further has a material 268. The material 268 of the crushed-flat two-liter bottle 258 of the preexisting two-liter bottle 256 of the bottle 228 is contained in a part of the crushed-flat two-liter bottle 258 of the preexisting two-liter bottle 256 of the bottle 228, extends from the crushed-flat closed bottom 264 of the crushed-flat two-liter bottle 258 of the preexisting two-liter bottle 256 of the bottle 228 approximately to the crushed-in dimple 248 of the upper wall 260 of the crushed-flat two-liter bottle 258 of the preexisting two-liter bottle 256 of the bottle 228, and is for thermal insulating.

The material 268 of the crushed-flat two-liter bottle 258 of the preexisting two-liter bottle 256 of the bottle 228 contained in the part of the crushed-flat two-liter bottle 258 of the preexisting two-liter bottle 256 of the bottle 228 is, preferably, air, a cellular air entrained concrete, or a closed-cell polyurethane foam 270, but is not limited to that.

E. Specific Configuration of a Third Embodiment of the Bottle 328.

Figure 8:
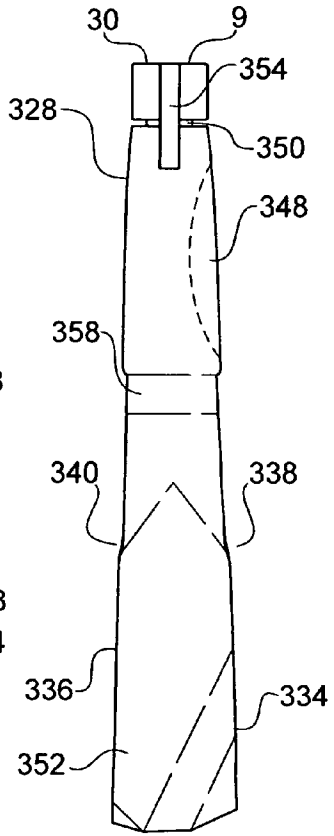
FIG. 8 is a diagrammatic side elevational view taken generally in the direction of ARROW 8 in FIG. 7.
Figure 7:
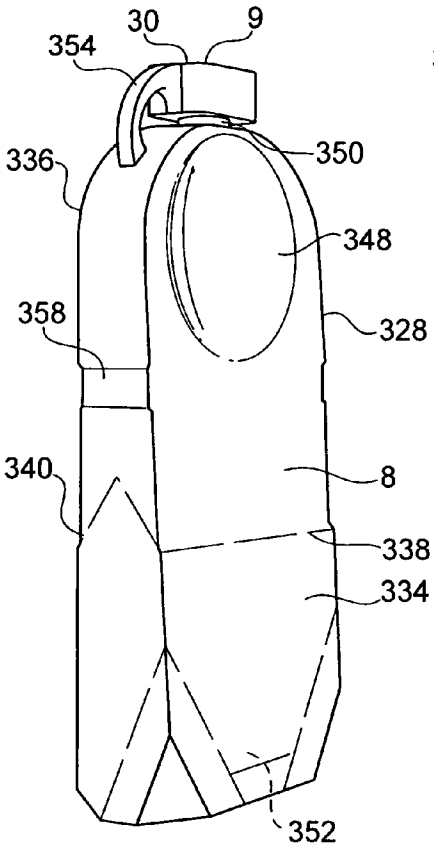
FIG. 7 is a diagrammatic perspective view of the interlocking tile of the environmentally friendly building system of the present invention shown in FIG. 6 prior to collapsing.
Figure 6:
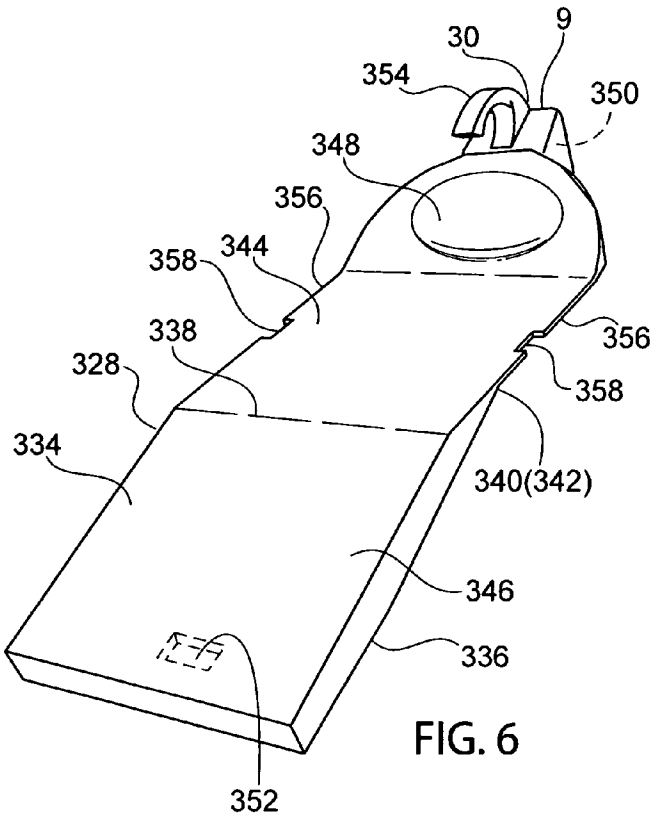
FIG. 6 is a diagrammatic perspective view of a third embodiment of an interlocking tile of the environmentally friendly building system of the present invention identified by ARROW 6 in FIG. 1.

The specific configuration of the bottle 328 can best be seen in FIGS. 6-8, which are, respectively, a diagrammatic perspective view of a third embodiment of an interlocking tile of the environmentally friendly building system of the present invention identified by ARROW 6 in FIG. 1, a diagrammatic perspective view of the interlocking tile of the environmentally friendly building system of the present invention shown in FIG. 6 prior to collapsing, and a diagrammatic side elevational view taken generally in the direction of ARROW 8 in FIG. 7, and as such, will be discussed with reference thereto.

The bottle 328 has an upper wall 334 and a lower wall 336.

The upper wall 334 of the bottle 328 has an intermediate line 338. The lower wall 336 of the bottle 328 has an intermediate line 340.

The intermediate line 338 of the upper wall 334 of the bottle 328 is below the intermediate line 340 of the lower wall 336 of the bottle 328.

The bottle 328 has a pinched line 342 thereat when the bottle 328 is collapsed (FIG. 6). The pinched line 342 of the bottle 328 divides the bottle 328 into an upper portion 344 and a lower portion 346.

The upper wall 334 of the bottle 328, at the upper portion 344 of the bottle 328, and the lower wall 336 of the bottle 328, at the upper portion 344 of the bottle 328, are in intimate contact with each other, and in combination with the pinched line 342 of the bottle 328, give an appearance that the bottle 328 is crushed (FIG. 6).

The lower portion 346 of the bottle 328 tapers towards the pinched line 342 of the bottle 328.

The upper portion 344 of the bottle 328 has a dimple 348. The dimple 348 of the upper portion 344 of the bottle 328 is in the upper wall 334 of the bottle 328, and is for providing an initial receptacle for water flowing down between adjacent tiles 22 thereabove.

The bottle 328 further has a neck 350. The neck 350 of the bottle 328 extends from the upper portion 344 of the bottle 328 to be received by the cap connector 30.

The lower portion 346 of the bottle 328 has a blind slot 352. The blind slot 352 of the lower portion 346 of the bottle 328 extends laterally in the lower wall 336 of the bottle 328, and receives the arm 354 of the connector cap 30 of the tile 22 therebelow.

The upper portion 344 of the bottle 328 has a pair of sides edges 356. The pair of side edges 356 of the upper portion 344 of the bottle 328 have a pair of notches 358, respectively. The pair of notches 358 of the pair of side edges 356 of the upper portion 344 of the bottle 328, respectively, provide clearance for the arm 354 of the cap connector 30 of each of the two adjacent tiles 22 therebelow.

F. Specific Configuration of a First Embodiment of the Cap Connector 500.

Figure 2:
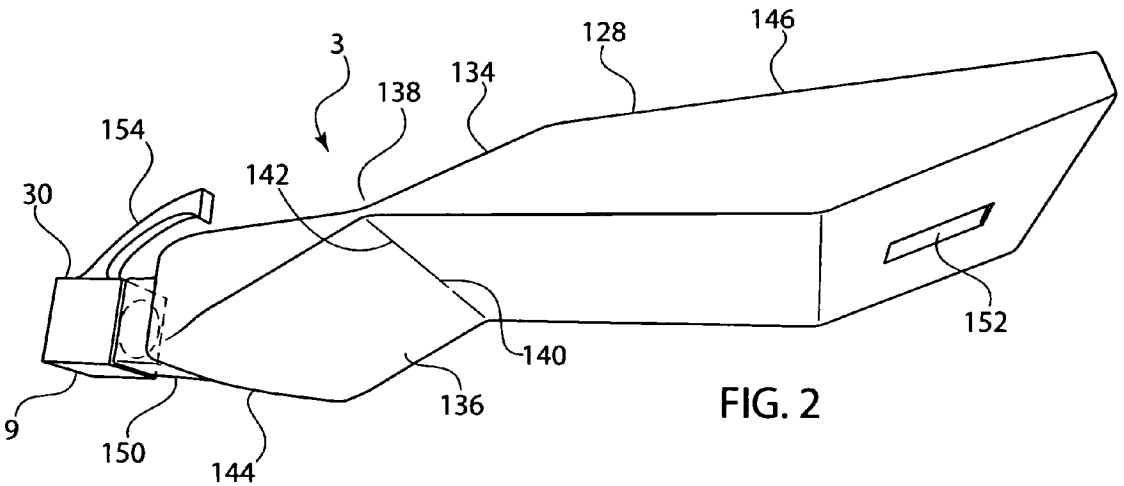
FIG. 2 is a diagrammatic perspective view of a first embodiment of an interlocking tile of the environmentally friendly building system of the present invention identified by ARROW 2 in FIG. 1.
Figure 3:
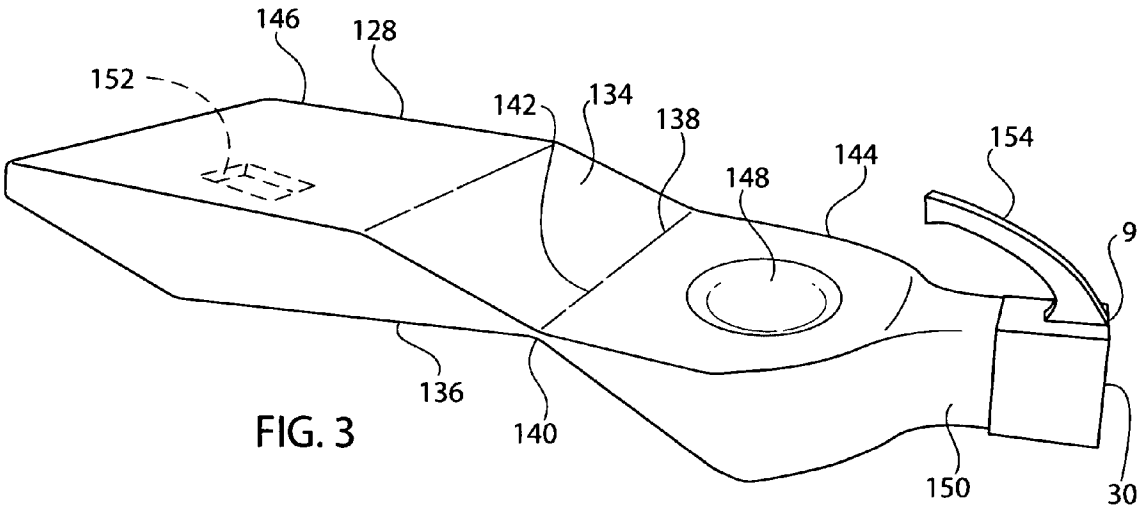
FIG. 3 is a diagrammatic perspective view taken generally in the direction of ARROW 3 in FIG. 2.
Figure 9:
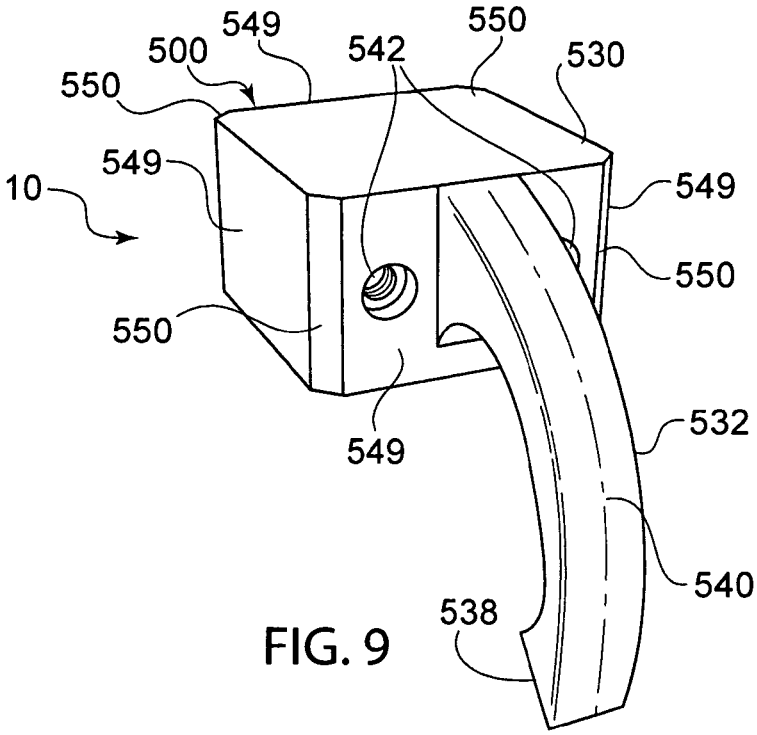
FIG. 9 is an enlarged diagrammatic perspective view of a first embodiment of the connecting cap of the environmentally friendly building system of the present invention identified by ARROW 9 in FIGS. 2, 3, and 6-8.
Figure 10:
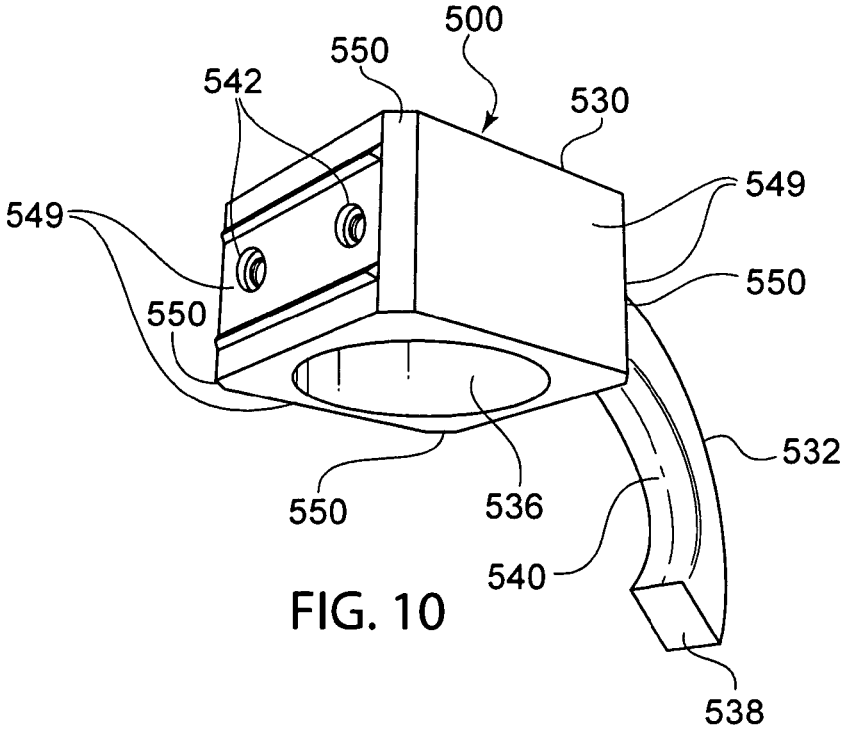
FIG. 10 is a diagrammatic perspective view taken generally in the direction of ARROW 10 in FIG. 9.
Figure 11:
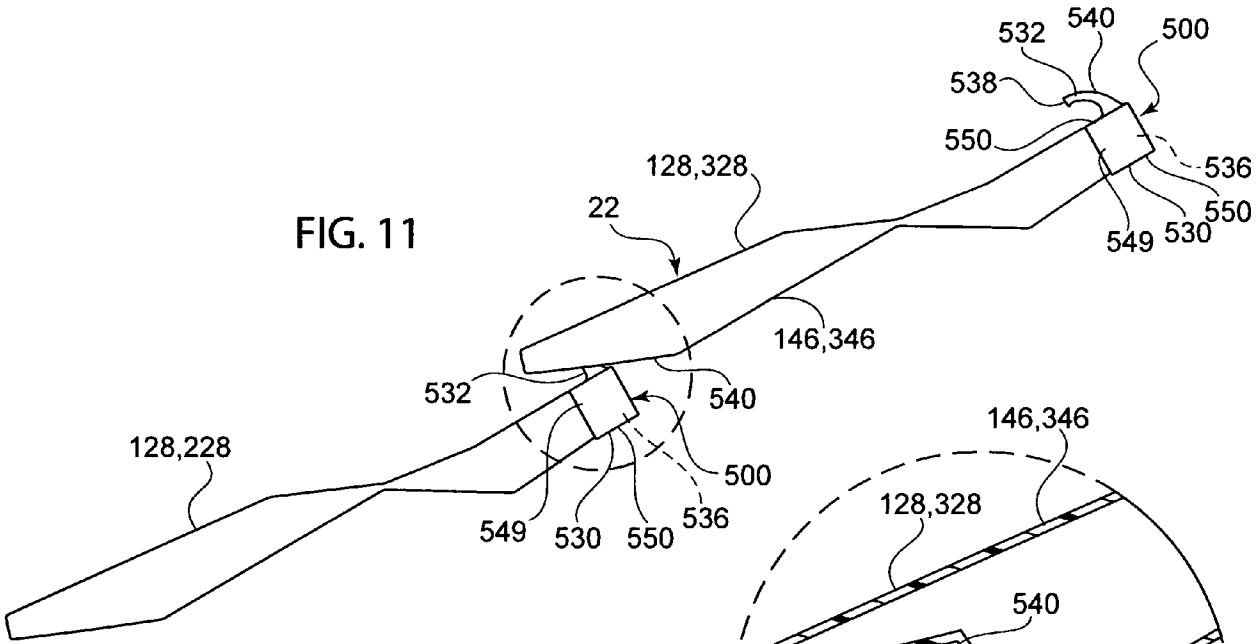
FIG. 11 is a reduced diagrammatic side elevational view of a pair of interlocking tiles of a type shown in FIGS. 2 and 3.
Figure 12:
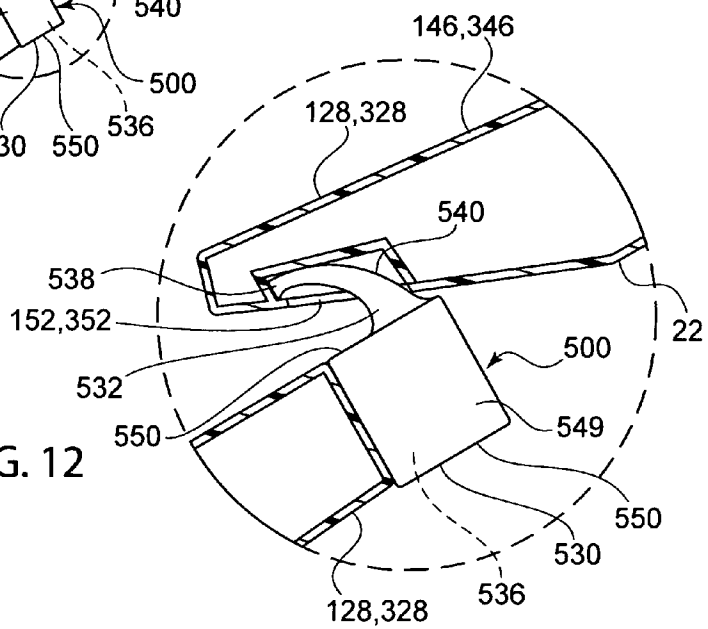
FIG. 12 is an enlarged diagrammatic cross sectional view of the area generally enclosed by the dotted curve identified by ARROW 12 in FIG. 11.

The specific configuration of the cap connector 500 can best be seen in FIGS. 9-12, which are, respectively, an enlarged diagrammatic perspective view of a first embodiment of the cap connector of the environmentally friendly building system of the present invention identified by ARROW 9 in FIGS. 2, 3, and 6-8, a diagrammatic perspective view taken generally in the direction of ARROW 10 in FIG. 9, a reduced diagrammatic side elevational view of a pair of interlocking tiles of a type shown in FIGS. 2 and 3, and an enlarged diagrammatic cross sectional view of the area generally enclosed by the dotted curve identified by ARROW 12 in FIG. 11, and as such, will be discussed with reference thereto.

The cap connector 500 comprises a body 530 and an arm 532.

The body 530 of the cap connector 500 has a blind bore 536 extending axially therein. The blind bore 536 in the body 530 of the cap connector 500 is for engaging a cap of the bottle 128, 328 (FIGS. 2, 3, and 6-8).

The arm 532 of the cap connector 500 extends arcuately outwardly from the body 530 of the cap connector 500 to a terminal end 538, and has a longitudinal axis of lateral symmetry 540.

The body 530 of the cap connector 500 further has a pair of through bores 542 extending laterally therethrough. The pair of through bores 542 in the body 530 of the cap connector 500 straddle the through bore 536 in the body 530 of the cap connector 500, and are for receiving a pair of screws for attaching the tile 22 of the laterally staggered roofing or siding 26 (FIG. 1).

The through bore 536 in the body 530 of the cap connector 500 is vertically oriented, and is generally somewhat cylindrically shaped for more better conformingly receiving the cap of the bottle 128, 328 (FIGS. 2, 3, and 6-8).

The body 530 of the cap connector 500 is generally cubically shaped, and has sides 549 and rounded edges 550 for protecting a hand of a user.

The arm 532 of the cap connector 500 extends arcuately and vertically outwardly from a side 549 of the body 530 of the cap connector 500 to the terminal end 538 of the arm 532 of the cap connector 500, which is received in the blind slot 152, 352 of the lower portion 146, 346 of the bottle 128, 328 of the tile, respectively, thereabove.

The body 530 of the cap connector 500 further has protruding ribs 552. The protruding ribs 552 of the body 530 of the cap connector 500 extend along a side 549 of the body 530 of the cap connector 500 opposite to the side 549 of the body 530 of the cap connector 500 from which the arm 532 of the cap connector 500 extends from, and are for assisting in fastening and preventing twisting of the cap connector 500 once installed, and, preferably, are linear, outwardly tapering, and straddle the pair of through bores 542 in the body 530 of the cap connector 500, but is not limited to that.

G. Specific Configuration of a Second Embodiment of the Cap Connector 600.

Figure 13:
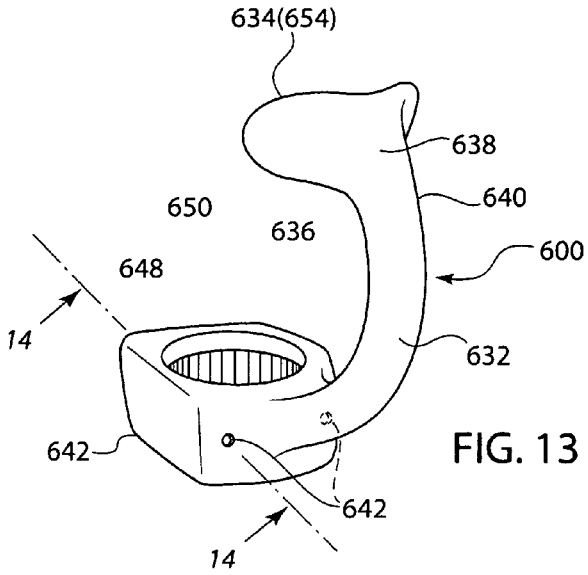
FIG. 13 is an enlarged diagrammatic perspective view of a second embodiment of the connecting cap of the environmentally friendly building system of the present invention identified by ARROW 13 in FIGS. 4 and 5.

The specific configuration of the cap connector 600 can best be seen in FIGS. 13 and 14, which are, respectively, an enlarged diagrammatic perspective view of a second embodiment of the cap connector of the environmentally friendly building system of the present invention identified by ARROW 13 in FIGS. 4 and 5, and an enlarged diagrammatic cross sectional view taken along LINE 14-14 in FIG. 13, and as such, will be discussed with reference thereto.

The cap connector 600 is similar to the cap connector 500, except for the addition of fingers 634 and vertically-oriented serrations 648.

Figure 4:
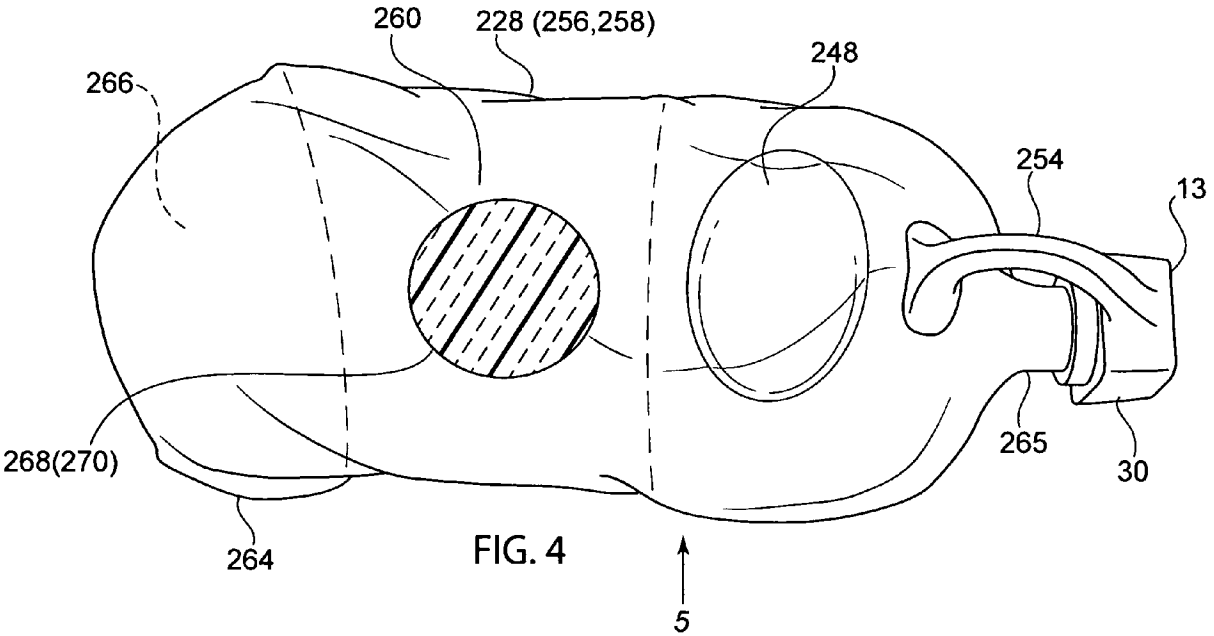
FIG. 4 is a partial cutaway diagrammatic perspective view of a second embodiment of an interlocking tile of the environmentally friendly building system of the present invention identified by ARROW 4 in FIG. 1.
Figure 5:
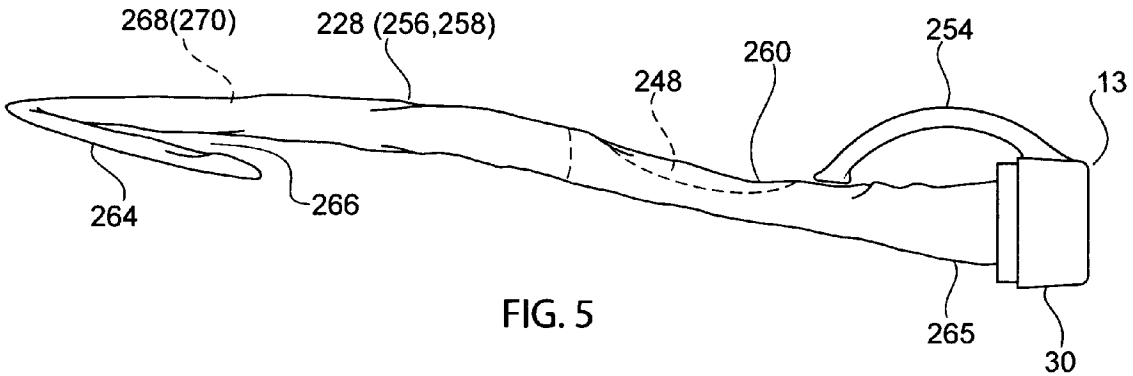
FIG. 5 is a diagrammatic side elevational view taken generally in the direction of ARROW 5 in FIG. 4.

The fingers 634 of the cap connector 600 extend laterally outwardly from the terminal end 638 of the arm 632 of the cap connector 600, from the longitudinal axis of lateral symmetry 640 of the arm 632 of the cap connector 600, and are for engaging the bottle 228 in such a manner so as to avoid puncturing the bottle 228 (FIGS. 4 and 5).

The fingers 634 of the cap connector 600 extend laterally outwardly from the terminal end 638 of the arm 632 of the cap connector 600, from both sides of the longitudinal axis of lateral symmetry 640 of the arm 632 of the cap connector 600, respectively, into a pair of arcuate wings 654. The pair of arcuate wings 654 of the fingers 634 of the cap connector 600 have contours for avoiding puncturing the bottle 228.

The through bore 636 in the body 630 of the cap connector 600 is defined by a peripheral wall 650. The peripheral wall 650 defining the through bore 636 in the body 630 of the cap connector 600 has the vertically-oriented serrations 648 of the cap connector 600 therearound. The vertically-oriented serrations 648 of the peripheral wall 650 defining the through bore 636 in the body 630 of the cap connector 600 are for frictionally engaging vertical serrations 652 on the cap 656 of the bottle 228 for more better gripping the cap 656 of the bottle 228.

Figure 14:
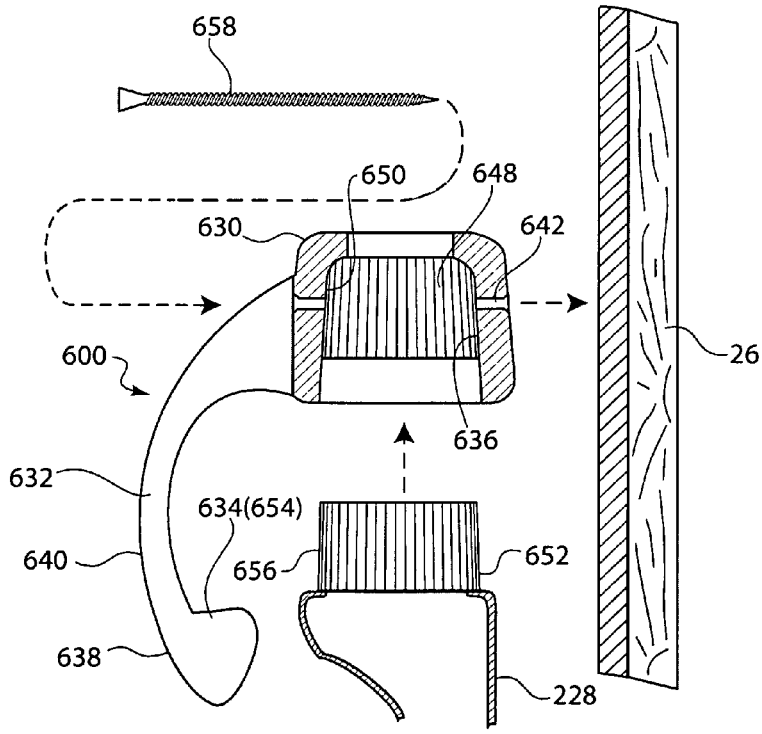
FIG. 14 is an enlarged diagrammatic cross sectional view taken along LINE 14-14 in FIG. 13.

As shown in FIG. 14, the pair of screws 658 pass into the pair of through bores 642 in the body 630 of the cap connector 600, respectively, for attaching the tile 22 of the laterally staggered roofing or siding 26.

H. Impressions.

It will be understood that each of the elements described above or two or more together may also find a useful application in other types of constructions differing from the types described above.

While the embodiments of the present invention have been illustrated and described as embodied in an environmentally friendly building system for promoting long term carbon capture and sequestration of roofing and siding by utilizing recycled/upcycled, collapsed, preformed, plastic, and post consumer material, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. An environmentally friendly building system for promoting long term carbon capture and sequestration of roofing and siding by utilizing recycled/upcycled, collapsed, preformed, and post consumer plastic material, comprising:

a plurality of tiles;

wherein said plurality of tiles interlock with each other to form overlapping courses of laterally staggered roofing or siding;

wherein each tile comprises a bottle;

wherein each tile comprises a cap connector;

wherein said cap connector of each tile caps off said bottle of an associated tile;

wherein said cap connector of each tile hooks into said bottle laying on top thereof so as to hold said overlapping courses of said laterally staggered roofing or siding in place; and wherein said bottle of each tile is made from recycled/upcycled, collapsed, preformed, and post consumer plastic material for promoting the long term carbon capture and sequestration of said laterally staggered roofing or siding so as to be environmentally friendly.

2. The environmentally friendly building system of claim 1, wherein said bottle has:

a) an upper wall; and b) a lower wall.

3. The environmentally friendly building system of claim 2, wherein said upper wall of said bottle has an intermediate line; and wherein said lower wall of said bottle has an intermediate line.

4. The environmentally friendly building system of claim 3, wherein said intermediate line of said upper wall of said bottle and said intermediate line of said lower wall of said bottle contact each other so as to allow said bottle to have a pinched line thereat.

5. The environmentally friendly building system of claim 4, wherein said upper wall of said bottle and said lower wall of said bottle are relatively close to each other, and in combination with said pinched line of said bottle, give an appearance that said bottle is crushed.

6. The environmentally friendly building system of claim 5, wherein said pinched line of said bottle divides said bottle into:

a) an upper portion; and b) a lower portion.

7. The environmentally friendly building system of claim 6, wherein said upper portion of said bottle and said lower portion of said bottle taper towards said pinched line of said bottle.

8. The environmentally friendly building system of claim 7, wherein said upper portion of said bottle has a dimple.

9. The environmentally friendly building system of claim 8, wherein said dimple of said upper portion of said bottle is in said upper wall of said bottle; and wherein said dimple of said upper portion of said bottle is for providing an initial receptacle for water flowing down between adjacent tiles thereabove.

10. The environmentally friendly building system of claim 9, wherein said bottle has a neck.

11. The environmentally friendly building system of claim 10, wherein said neck of said bottle extends from said upper portion of said bottle; and wherein said neck of said bottle is received by said cap connector.

12. The environmentally friendly building system of claim 11, wherein said lower portion of said bottle has a blind slot.

13. The environmentally friendly building system of claim 12, wherein said blind slot of said lower portion of said bottle extends laterally in said lower wall of said bottle; and wherein said blind slot of said lower portion of said bottle receives an arm of said connector cap of said tile therebelow.

14. The environmentally friendly building system of claim 1, wherein said bottle is a preexisting two-liter bottle.

15. The environmentally friendly building system of claim 14 wherein said preexisting two-liter bottle of said bottle is made from polyethylene terephthlate plastic.

16. The environmentally friendly building system of claim 15, wherein said preexisting two-liter bottle of said bottle is a crushed-flat two-liter bottle.

17. The environmentally friendly building system of claim 16, wherein said crushed-flat two-liter bottle of said preexisting two-liter bottle of said bottle has:

a) an upper wall;

b) a lower wall;

c) a crushed-flat closed bottom; and d) a neck.

18. The environmentally friendly building system of claim 17, wherein said upper wall of said crushed-flat two-liter bottle of said preexisting two-liter bottle of said bottle and said lower wall of said crushed-flat two-liter bottle of said preexisting two-liter bottle of said bottle are in intimate generally flat relationship to each other.

19. The environmentally friendly building system of claim 18, wherein said crushed-flat closed bottom of said crushed-flat two-liter bottle of said preexisting two-liter bottle of said bottle is bent onto said lower wall of said crushed-flat two-liter bottle of said preexisting two-liter bottle of said bottle so as to form a blind slot therebetween.

20. The environmentally friendly building system of claim 19, wherein said blind slot of said crushed-flat two-liter bottle of said preexisting two-liter bottle of said bottle extends laterally thereacross; and wherein said blind slot of said crushed-flat two-liter bottle of said preexisting two-liter bottle of said bottle receives an arm of said connector cap of said tile therebelow.

21. The environmentally friendly building system of claim 20, wherein said upper wall of said crushed-flat two-liter bottle of said preexisting two-liter bottle of said bottle has a crushed-in dimple.

22. The environmentally friendly building system of claim 21, wherein said crushed-in dimple of said upper wall of said crushed-flat two-liter bottle of said preexisting two-liter bottle of said bottle is just below said neck of said crushed-flat two-liter bottle of said preexisting two-liter bottle of said bottle; and wherein said crushed-in dimple of said upper wall of said crushed-flat two-liter bottle of said preexisting two-liter bottle of said bottle is for providing an initial receptacle for water flowing down between adjacent tiles thereabove.

23. The environmentally friendly building system of claim 22, wherein said crushed-flat two-liter bottle of said preexisting two-liter bottle of said bottle has a foam; and wherein said foam of said crushed-flat two-liter bottle of said preexisting two-liter bottle of said bottle is for thermal insulating.

24. The environmentally friendly building system of claim 23, wherein said foam is contained in part of said crushed-flat two-liter bottle of said preexisting two-liter bottle of said bottle.

25. The environmentally friendly building system of claim 24, wherein said foam of said crushed-flat two-liter bottle of said preexisting two-liter bottle of said bottle extends from said crushed-flat closed bottom of said crushed-flat two-liter bottle of said preexisting two-liter bottle of said bottle approximately to said crushed-in dimple of said upper wall of said crushed-flat two-liter bottle of said preexisting two-liter bottle of said bottle.

26. The environmentally friendly building system of claim 25, wherein said material of said crushed-flat two-liter bottle of said preexisting two-liter bottle of said bottle is air.

27. The environmentally friendly building system of claim 25, wherein said material of said crushed-flat two-liter bottle of said preexisting two-liter bottle of said bottle is a cellular air entrained concrete.

28. The environmentally friendly building system of claim 25, wherein said material of said crushed-flat two-liter bottle of said preexisting two-liter bottle of said bottle is a closed-cell polyurethane foam.

29. The environmentally friendly building system of claim 3, wherein said intermediate line of said upper wall of said bottle is below said intermediate line of said lower wall of said bottle, and has a pinched line thereat.

30. The environmentally friendly building system of claim 29, wherein said pinched line of said bottle divides said bottle into:

a) an upper portion; and b) a lower portion.

31. The environmentally friendly building system of claim 30, wherein said upper wall of said bottle, at said upper portion of said bottle, and said lower wall of said bottle, at said upper portion of said bottle are in intimate contact with each other.

32. The environmentally friendly building system of claim 31, wherein said lower portion of said bottle tapers towards said pinched line of said bottle.

33. The environmentally friendly building system of claim 32, wherein said upper portion of said bottle has a dimple.

34. The environmentally friendly building system of claim 33, wherein said dimple of said upper portion of said bottle is in said upper wall of said bottle; and wherein said dimple of said upper portion of said bottle is for providing an initial receptacle for water flowing down between adjacent tiles thereabove.

35. The environmentally friendly building system of claim 34, wherein said bottle has a neck;

wherein said neck of said bottle extends from said upper portion of said bottle; and wherein said neck of said bottle is received by said cap connector.

36. The environmentally friendly building system of claim 35, wherein said lower portion of said bottle has a blind slot.

37. The environmentally friendly building system of claim 36, wherein said blind slot of said lower portion of said bottle extends laterally in said lower wall of said bottle; and wherein said blind slot of said lower portion of said bottle receives an arm of said connector cap of said tile therebelow.

38. The environmentally friendly building system of claim 37, wherein said upper portion of said bottle has a pair of sides edges;

wherein said pair of side edges of said upper portion of said bottle have a pair of notches, respectively; and wherein said pair of notches of said pair of side edges of said upper portion of said bottle, respectively, provide clearance for an arm of said cap connector of each of said two adjacent tiles therebelow.

39. The environmentally friendly building system of claims 13, 26, 27, 28 or 36, wherein said cap connector comprises:

a) a body; and b) an arm.

40. The environmentally friendly building system of claim 39, wherein said body of said cap connector has a blind bore extending axially therein; and wherein said blind bore in said body of said cap connector is for engaging a cap of said bottle.

41. The environmentally friendly building system of claim 40, wherein said arm of said cap connector extends arcuately outwardly from said body of said cap connector to a terminal end; and wherein said arm of said cap connector has a longitudinal axis of lateral symmetry.

42. The environmentally friendly building system of claim 41, wherein said body of said cap connector has a pair of through bores extending laterally therethrough;

wherein said pair of through bores in said body of said cap connector straddle said blind bore in said body of said cap connector; and wherein said pair of through bores in said body of said cap connector are for receiving a pair of screws for attaching said tile of said laterally staggered roofing or siding.

43. The environmentally friendly building system of claim 42, wherein said blind bore in said body of said cap connector is vertically oriented; and wherein said blind bore in said body of said cap connector is generally somewhat cylindrically shaped for more better conformingly receiving said cap of said bottle.

44. The environmentally friendly building system of claim 43, wherein said body of said cap connector is generally cubically shaped.

45. The environmentally friendly building system of claim 44, wherein said body of said cap connector has rounded edges for protecting a hand of a user.

46. The environmentally friendly building system of claim 45, wherein said body of said cap connector has sides;

wherein said arm of said cap connector extends arcuately and vertically outwardly from a side of said body of said cap connector to said terminal end of said arm of said cap connector; and wherein said arm of said cap connector is received in said blind slot of said lower portion of said bottle of said tile thereabove.

47. The environmentally friendly building system of claim 46, wherein said body of said cap connector has protruding ribs; and wherein said protruding ribs of said body of said cap connector are for assisting in fastening and preventing twisting of said cap connector once installed.

48. The environmentally friendly building system of claim 47, wherein said protruding ribs of said body of said cap connector extend along a side of said body of said cap connector opposite to said side of said body of said cap connector from which said arm of said cap connector extends from.

49. The environmentally friendly building system of claim 48, wherein said protruding ribs of said body of said cap connector are linear;

wherein said protruding ribs of said body of said cap connector are outwardly tapering; and wherein said protruding ribs of said body of said cap connector straddle the pair of through bores in the body of said cap connector.

50. The environmentally friendly building system of claim 49, wherein said cap connector comprises fingers.

51. The environmentally friendly building system of claim 50, wherein said fingers of said cap connector extend laterally outwardly from said terminal end of said arm of said cap connector, from said longitudinal axis of lateral symmetry of said arm of said cap connector; and wherein said fingers of said cap connector are for engaging said bottle in such a manner so as to avoid puncturing said bottle.

52. The environmentally friendly building system of claim 51, wherein said fingers of said cap connector extend laterally outwardly from said terminal end of said arm of said cap connector, from both sides of said longitudinal axis of lateral symmetry of said arm of said cap connector, respectively, into a pair of arcuate wings.

53. The environmentally friendly building system of claim 52, wherein said pair of arcuate wings of said fingers of said cap connector have contours for avoiding puncturing said bottle.

54. The environmentally friendly building system of claim 53, wherein said through bore in said body of said cap connector is defined by a peripheral wall;

wherein said peripheral wall defining said through bore in said body of said cap connector has vertically-oriented serrations therearound; and wherein said vertically-oriented serrations of said peripheral wall defining said through bore in said body of said cap connector are for frictionally engaging vertical serrations on said cap of said bottle for more better gripping said cap of said bottle.

55. The environmentally friendly building system of claim 54, further comprising a pair of screws;

wherein said pair of screws pass into said pair of through bores in said body of said cap connector, respectively, for attaching said tile of said laterally staggered roofing or siding.

* * * * *